US007739757B2

(12) United States Patent
Witt

(10) Patent No.: US 7,739,757 B2
(45) Date of Patent: Jun. 22, 2010

(54) SHOWER BASE WITH FLOW ENHANCING COVERED DRAIN

(75) Inventor: Kevin L Witt, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 726 days.

(21) Appl. No.: 11/613,272

(22) Filed: Dec. 20, 2006

(65) Prior Publication Data

US 2008/0148474 A1 Jun. 26, 2008

(51) Int. Cl.
*A47K 3/00* (2006.01)

(52) U.S. Cl. ..... 4/613; 4/612

(58) Field of Classification Search ..... 4/520, 4/290, 293, 613, 653, 612, 673, 596, 286, 4/288; 210/163
See application file for complete search history.

(56) References Cited

U.S. PATENT DOCUMENTS

| | | | | |
|---|---|---|---|---|
| 3,457,568 | A | 7/1969 | Amatruda | |
| RE31,561 | E | 4/1984 | Thompson | |
| D333,342 | S | 2/1993 | Newhard | |
| 5,341,523 | A | 8/1994 | Barnes | |
| D351,019 | S | 9/1994 | Moore et al. | |
| 5,458,769 | A | 10/1995 | Johannessen | |
| 5,894,611 | A | 4/1999 | Toro | |
| 6,817,043 | B2 | 11/2004 | Zars | |
| D532,877 | S | 11/2006 | Hisey | |
| 2003/0141231 | A1* | 7/2003 | Rattenbury et al. | 210/163 |
| 2005/0028270 | A1* | 2/2005 | Nehring | 4/613 |

FOREIGN PATENT DOCUMENTS

| | | |
|---|---|---|
| DE | 20 2006 009 037 U | 8/2006 |
| FR | 97 14819 | 11/1997 |
| WO PCT/US/2007/024315 | | 11/2007 |

OTHER PUBLICATIONS

Sterling. "Ensemble, Series 7213, 60" Shower Receptor. "Model No. 72131100". SterlingPlumbing.com online catalog. Online catalog page, dated Oct. 26, 2005.
Delafon. "Shower Receptors". Model Nos. E2192, E2193, E2194, E2196, E N185, E N191, E N186, E N187 and E N188. Delafon catalog p. 106. Admitted prior art.
Duravit. Tub for Bathing. Admitted prior art.
Kallista. "Barbara Barry Barry Collection—Toilet Lid". Model No. P70070-00-00. Kallista catalog. Copyright 1999 Kallista Inc.

* cited by examiner

*Primary Examiner*—Gregory L Huson
*Assistant Examiner*—Janie Christiansen
(74) *Attorney, Agent, or Firm*—Quarles & Brady LLP

(57) ABSTRACT

A shower enclosure base has a flow enhancing flush-mounted drain cover that conceals the drain opening and provides a flat stepping surface. Drain flow is achieved through a narrow peripheral passage between the drain cover and the drain well in which it is seated. Despite the reduced flow area of passage, flow enhancing features of the drain cover serve to improve the flow rate through the drain. These features are radially converging ribs at the underside of the drain cover that interrupt the natural tendency for drain water to form a vortex as it passes into and through a circular drain opening. The drain cover can be removably secured to the base by suction cups that attach to the drain well.

18 Claims, 4 Drawing Sheets

SHOWER BASE WITH FLOW ENHANCING COVERED DRAIN

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to plumbing fixtures, and more particularly to the drain at the base of a shower enclosure.

Bathroom plumbing fixtures such as bath tubs, spas, whirlpools, shower stalls, shower surrounds, free standing partial or full shower enclosures, etc., are well known. Such fixtures can be installed in combination or as separate and discrete fixtures. In the case of stand alone shower enclosures, the upright walls that surround the enclosure are typically mounted onto to a generally flat base, sometimes referred to in the industry as a shower or base "receptor". U.S. Pat. No. 3,457,568 provides an example of a prior art base receptor.

In addition to supporting the enclosure walls, the shower base receptor is also the floor of the enclosure on which a person stands during a shower. As such, the floor surface needs to be capable of bearing loads as well as flat and free of uneven surfaces that would be difficult or uncomfortable to stand on. At the same, the base receptor must have a drain to evacuate the water from the shower.

Many conventional base receptors provide for a recessed drain opening that is only covered by a small grate having openings for the water to pass through. The grate is recessed as well to be generally flush with the floor. However, the openings in the grate must be left unblocked and otherwise make it uncomfortable to stand on with bare feet, and therefore, the usable floor space in the enclosure is effectively reduced by the area of the grate where a person in the shower would avoid standing.

One approach to overcoming this problem is disclosed in U.S. Pat. No. 5,458,769. This patent describes a floor drain that can be used in a shower environment, albeit not specifically disclosed as for a base receptor, in which the drain opening is covered by a "bell" that can be mounted within the drain opening so that its generally flat, smooth top surface is flush (or near flush) with the surrounding floor. Fluid drains into the drain opening through a narrow passage extending around the periphery of the bell. The bell provides an improved and enlarged stepping area than conventional grates since one can comfortably stand on the smooth top surface of the bell without blocking drain flow through the narrow peripheral passage.

However, this type of covered drain typically significantly reduces the effective passage area through which water can drain, thereby reducing flow rate and possible causing flow back-up and standing water in the base receptor. Standing in drain water is unpleasant, and the raised water can slip over the short rim of the receptor base.

The slow drain problem is exacerbated when the water passing through the drain forms a vortex caused by the coriolis effect arising from suction through the drain. The vortex generates a whirlpool-like swirling action in the water as it passes down through the drain. The swirling action of the water passing through the drain can cause water that would otherwise be at the center of the drain to move outwardly toward the drain walls. The unoccupied space in the center of the drain thus effectively diminishes the passage area of the drain, and in further slows the flow rate.

Anti-vortex drains have been developed to break the vortex and allow water to pass through the full area of the drain. These anti-vortex drains are known in the swimming pool industry, and are used to address problems with debris clogging the drain and/or circulatory pumping system of the pool. They have also be developed to address safety concerns caused by the force of the suction of the circulatory system pulling body parts, particularly that of small children, toward or into the drain.

U.S. Pat. No. 5,341,523 discloses one prior art anti-vortex drain for a swimming pool application. The disclosed drain breaks up the vortex at the drain by using a large, flat circular cover flush-mounted within the drain opening. Water drains around the circular periphery of the cover in a more steady manner with less swirling action. The disclosed drain provides for adjustment of the opening size of the peripheral passage to allow for slight flow rate adjustment.

The disclosed drain would be too large and cumbersome for use in a shower receptor. Moreover, like other conventional covered drains, the reduction in drain passage area caused by use of the cover would slow the flow rate through the drain excessively in gravity feed drainage systems, such as shower applications, such that water would likely accumulate around the drain. Thus, the drain disclosed in the '423 patent, even though it is able to reduce or eliminate the vortexes and allow for passage area adjustment, would likely be suitable only for large volume applications, such as pools, which have forced flow circulatory systems and do not need to prevent water from accumulating around the drain.

Hence, a need exists to provide a shower base receptor with a covered drain system that has enhanced flow characteristics.

SUMMARY OF THE INVENTION

The invention provides a base and drain assembly for a shower enclosure. Specifically, the base has a receptor for mounting at least one upright wall of the shower enclosure. The receptor base also has a floor, a drain well and a drain opening. The drain well is recessed into the floor at the drain opening and defines a drain well perimeter extending about the drain opening. A drain cover is mounted within the drain well above the drain opening in essentially flush relation with adjacent areas of the floor. The drain cover has a drain cover perimeter spaced from the drain well perimeter so as to define a peripheral passage therebetween for peripheral flow to the drain opening beneath the drain cover. The drain cover has one or more anti-vortex ribs extending along an underside of the drain cover and toward the drain opening proximate the drain opening so as to disrupt a vortex in the water passing through the drain opening.

A preferred radially converging array lays out the ribs in angular spaced apart relation extend in radial directions such that a centerline of each rib intersects a vertical central axis of the drain cover. The ribs can be radially spaced from and symmetric about the central axis, such as in an even number of ribs, for example four, opposed to each other on opposite sides of the central axis. At least one anti-vortex rib extends to a prescribed height above the drain opening, preferably less than 0.25 inches, and more preferably between 0.10 and 0.15 inches, such as 0.13 inches. Further, one or more of the anti-vortex ribs can be contoured to follow a contour of at least one of the drain well and the drain opening. The ribs are preferably formed as a unitary part of the drain cover extending downwardly along the underside thereof.

The drain cover has an essentially planar upper surface. The drain cover perimeter is defined by at least four sides. One or more of the sides can be straight and/or one or more of the sides can be curved. In any case, the peripheral passage for drain flow can be made to be of an essentially constant dimension about the drain cover. The drain cover can have one or more edge spacers, such as one at each corner, for maintaining the horizontal dimension of the peripheral passage. The drain cover can also have one or more stand offs, again such as one each corner, for contacting the drain well and achieving a vertical gap between the drain well and other portions of the drain cover. Furthermore, the drain cover can be adapted for removable attachment to the base receptor, such as having one or more suction cups for attaching to the surface of the drain well.

Thus, the shower base receptor and drain assembly of the present invention provides a covered drain system with enhanced flow characteristics, particularly increased flow rate through the drain when compared to an uncovered drain of the same opening dimension.

Other advantages of the invention will be apparent from the detailed description which follows and accompanying drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF THE PREFERRED EMBODIMENT

Figure 1:
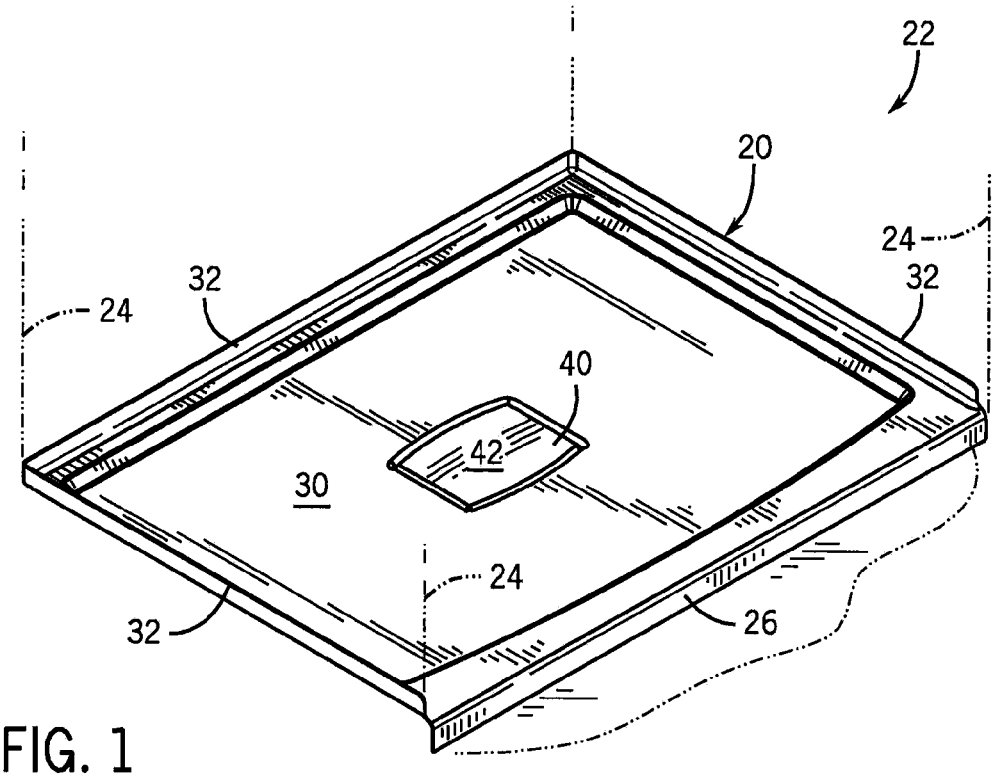
FIG. 1 is perspective view of a shower receptor having a flow enhancing covered drain according to the present invention.
Figure 2:
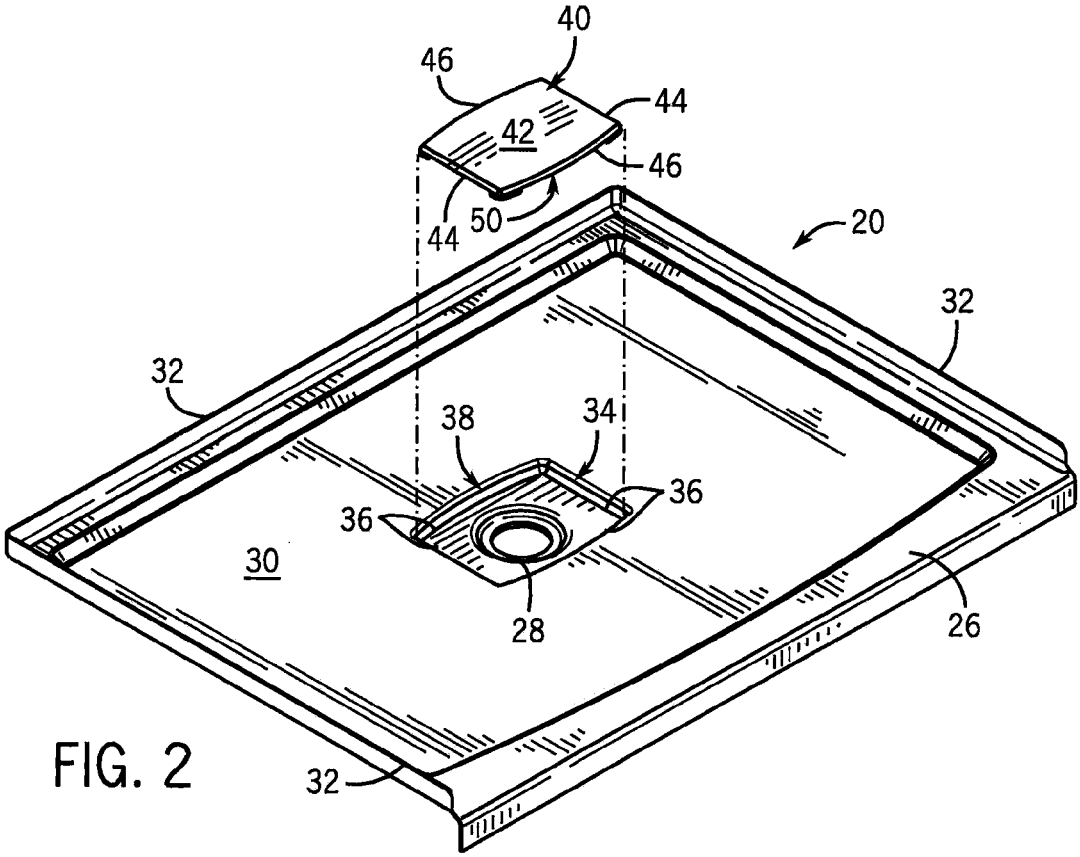
FIG. 2 is a similar perspective view showing the drain cover exploded from the shower receptor.
Figure 3:
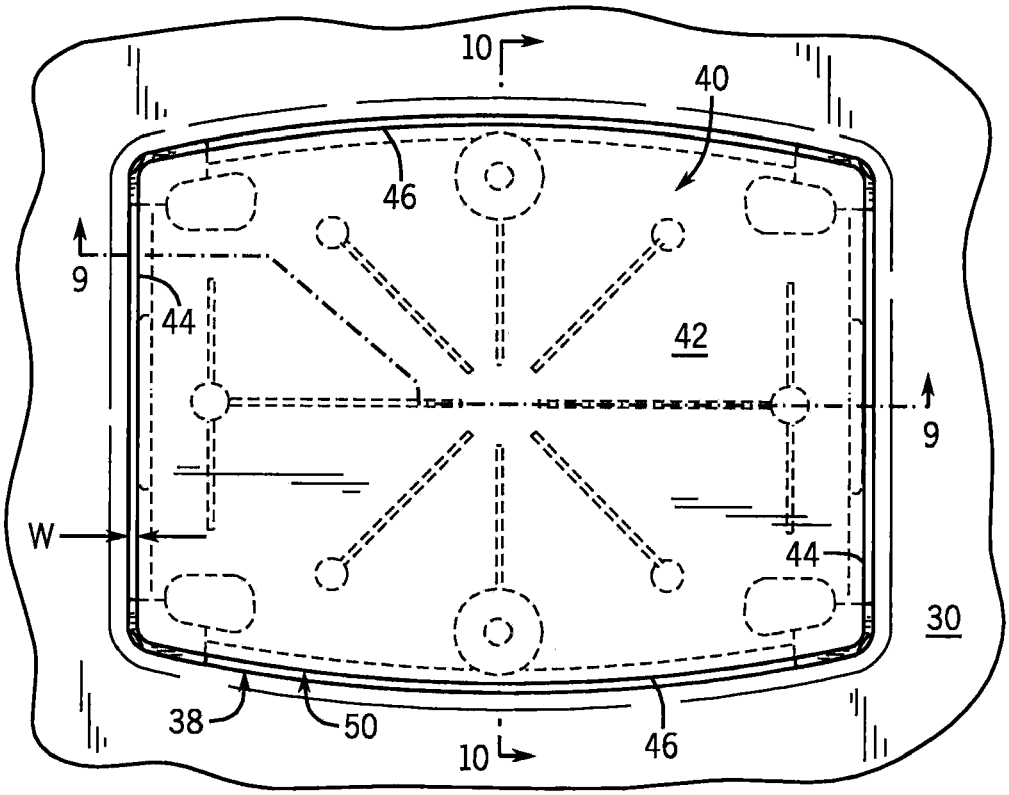
FIG. 3 is top plan view of the covered drain as shown in FIG. 1.
Figure 4:
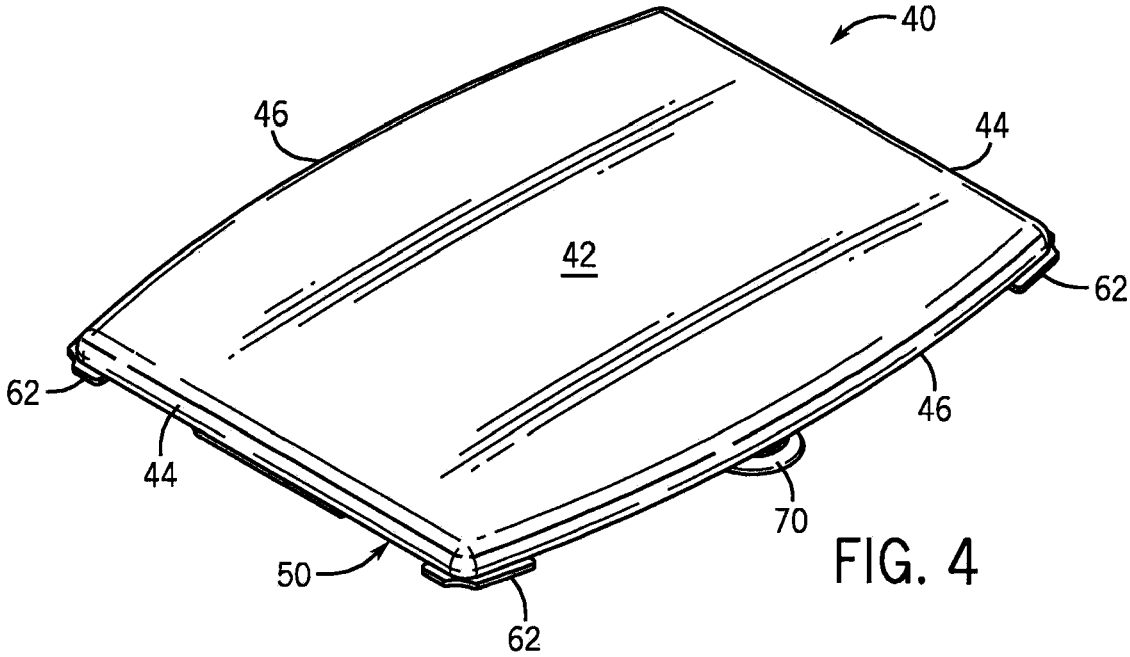
FIG. 4 is a perspective view of the drain cover of FIG. 1 in isolation.
Figure 5:
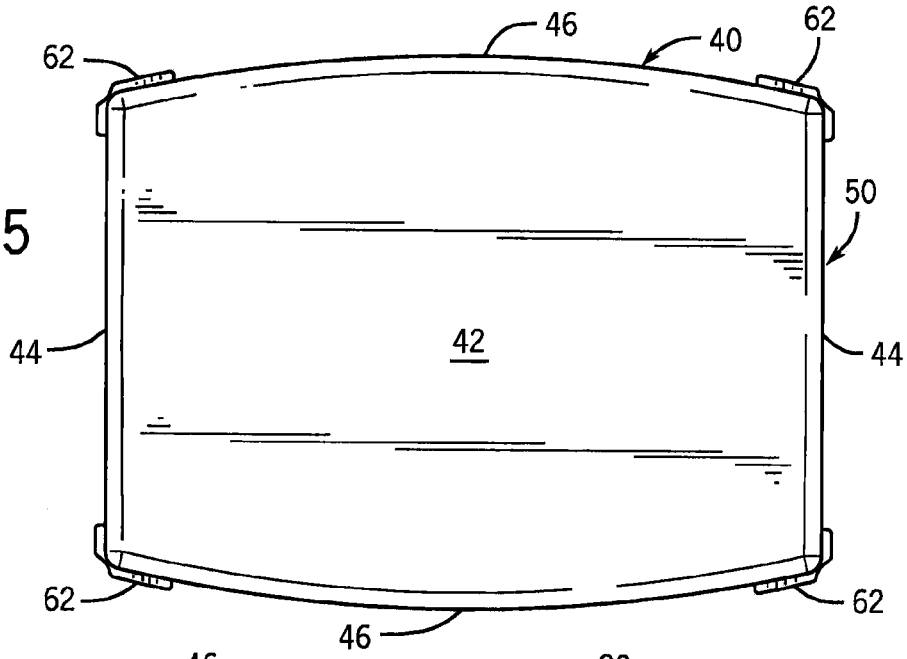
FIG. 5 is a top plan view thereof.
Figure 6:
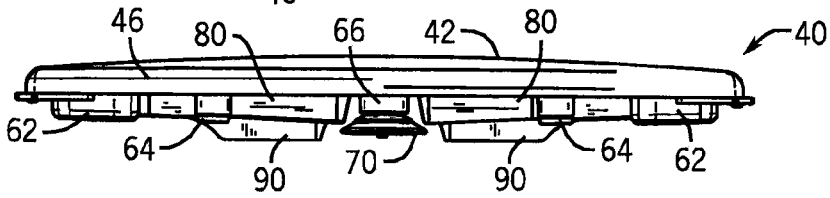
FIG. 6 is a front elevational view thereof.
Figure 7:
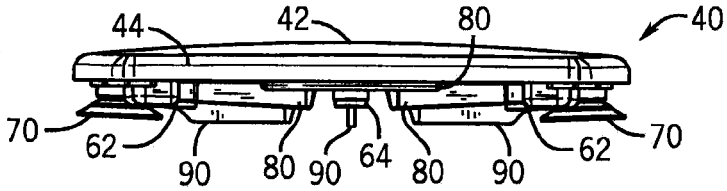
FIG. 7 is an end elevational view thereof.

The accompanying FIGS. 1-10 illustrate a preferred embodiment of a base and drain assembly 20 according to the present invention for a shower enclosure, referred to generally by numeral 22. The term "shower enclosure" is used herein to refer to an area where water is sprayed down onto a person that is either standing or sitting. This area can have one or more upright walls 24, three walls are shown in phantom in FIG. 1, and a door or curtain (not shown) so that it is either fully or partially enclosed along one or more sides or the entire boundary of the area. Although not shown, a curtain or a pivotal door could be mounted at the front of the shower enclosure 22 for privacy and to keep water from splashing out of the enclosure.

The assembly 20 includes a receptor base 26 providing a drain opening 28 and floor 30 of the shower enclosure 22. The upright walls 24 are supported by the receptor base 24 along the peripheral edges and adjacent the rear and side flanges 32. The floor 30 is a dished bottom surface that slopes toward the drain opening 28 located in a recessed drain well 34 at its center. The drain well 34 has a generally vertical edge walls 36 defining the drain well periphery 38.

The drain well 34 removably receives a drain cover 40 as shown in FIGS. 1, 2, 3, 9 and 10. The drain cover 40 mounts inside the drain well 34 so as to be essentially flush with the surrounding areas of the floor 30. Referring to FIGS. 4-8, the drain cover 40 has a smooth, generally flat top surface 42 that terminates at a four-sided peripheral edge having straight, parallel short sides 44 and two convex long sides 46 extending between the short sides 44. The sides 44 and 46 define the drain cover periphery 50. The flush mounting and smooth, flat surface at the top of the drain cover 40 make it comfortable to stand on.

The underside of the drain cover 40 has several elements formed integrally with the top surface 42. Four receptors 60 are formed at the four corners of the drain cover 40 for support elastomeric stand-offs 62 providing contact surfaces resting against both the recessed floor within the drain well 34 as well as the peripheral edge walls defining the drain well periphery 38. The stand-offs 62 thus provide firm, yet slightly cushioned contact areas for the drain cover 40 to seat inside the drain well 34 centered within the drain well periphery 38. Of course, the stand-offs 62 could be formed of the same material as the rest of the drain cover 40, however, using a co-molding process the elastomeric material can be used to permit flexibility along a controlled range of vertical and lateral movement of the drain cover 40 within the drain well 42 when a load is applied to the drain cover 40. Six small cylindrical "buttons" 64 with co-molded elastomeric material are also formed at the underside of the drain cover 40 to provide for cushioned structural support against vertical loading.

For example, under wet conditions, a 70 lb-f load and with the stand-off spaced 0.63 inches from the drain cover periphery, the drain cover 40 could be permitted to move at the short sides 44 laterally (horizontally) 0.011 inches and vertically 0.007 inches, at the long sides 0.04 inches laterally and 0.005 inches vertically, and at the and corners 0.19 inches at the corners, and 0.008 inches vertically. Moreover, it is further noted that each of the stand-offs 62 could be formed in two parts, one for supporting vertical loads and one for centering the drain cover 40 in the drain well 34. It should be noted that while these values are provide for a 70 lb-f load, the drain cover 40 is preferably rated for 300 lb-f loads, as is commonly required by code for grates.

Furthermore, the underside of the drain cover 40 has two receptors 66 near the midpoint of the long sides 46 for receiving suction cups 70. The suction cups 70 removably attach to the floor within the drain well 34 and apply a releasable vertical (and lateral) suction force tending to keep the drain cover 40 mounted within the drain well 34.

By centering the drain cover 40 within the drain well 34 and limiting the movement therein, the stand-offs 62 serve to maintain a peripheral passage 78 extending about the drain cover 40 at the spacing between the drain cover periphery 50 and the drain well periphery 38. In the preferred embodiment described herein, the peripheral passage 78 is of an essentially constant gap width "W" (see FIG. 3), or lateral or horizontal dimension, along its entire length. Aesthetics are enhanced by keeping the gap width as narrow as possible. However, when the gap width is so small that it corresponds to a lower passage area than that of the drain opening 28 the drain cover 40 may become a restriction to drain flow such that flow rate is diminished sufficiently to cause water to accumulate in the receptor base 24. Other factors will also affect the selection of the gap width. Such factors include the shower flow rate, the number of shower heads, the location and direction of spray and the slope the receptor base floor. However, it has been determined empirically that a gap width dimension of between 0.1 and 0.25 inches is suitable for many common household shower applications with a 2 inch inner diameter drain opening, with a range of 0.13 to 0.16 inches being even more preferable. In the preferred embodiment described herein, a 0.13 inch gap width corresponds to a 5 square inch passage area and a 0.16 gap width corresponds to a 6.2 square inch passage area.

Figure 8:
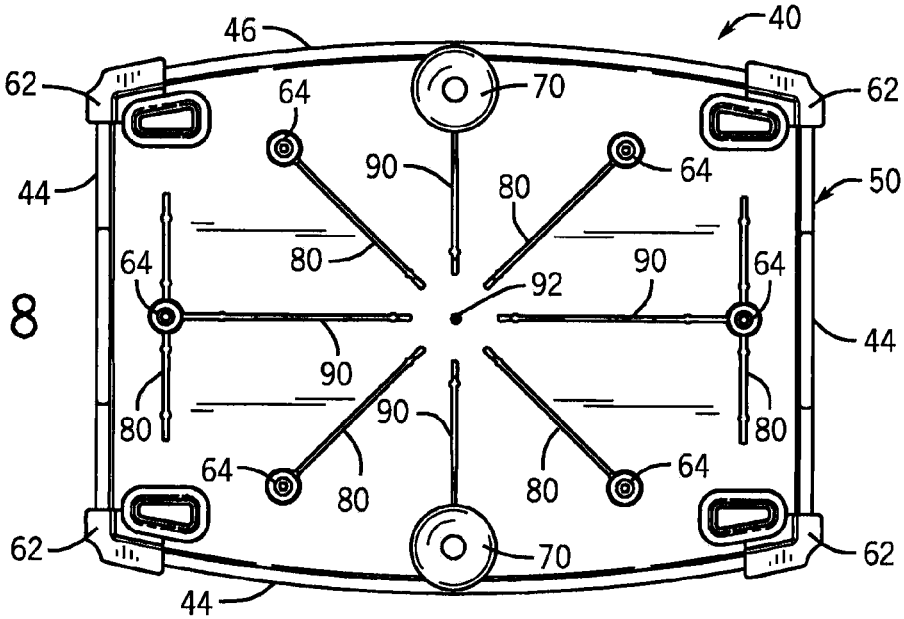
FIG. 8 is a bottom plan view thereof.

As best shown in FIG. 8, in addition to these elements, the underside of the drain cover 40 includes a number of ribs, including structural ribs 80 and anti-vortex ribs 90. Two of the structural ribs 80 extend near and parallel to the short sides 44, intersecting the two buttons 64 nearest the short sides 44. The other four structural ribs 80 are arranged in a diagonal, radially converging pattern extending from the four buttons 64 toward the center of the drain cover 40 intersected by a vertical center axis 92 thereof (see FIG. 8).

The four anti-vortex ribs 90 are arranged in a radially converging pattern as well. In the orientation of the drain cover 40 as shown in FIG. 8, the anti-vortex ribs 90 at the 12 o'clock and 6 o'clock positions extending radially toward the center axis 92 from the suction cup receptors 66. The other two anti-vortex ribs 90 are at the 3 o'clock and 9 o'clock positions and extend from the buttons 64 that intersect the structural ribs 80 at the short sides 44 of the drain cover 40.

The arrangement and quantity of anti-vortex (and structural) ribs can vary. However, the radial array arrangement allows the ribs to channel water toward the center of the drain opening 28 from all sides of the drain cover 40 along the entire drain cover periphery 50. While other arrangements could be used, those that act as baffles or others impede flow to the drain opening 28 should be avoided so as not to slow the flow rate.

The number of anti-vortex ribs in the preferred embodiment described herein was selected to be four after empirical evidence determined an increased flow rate when compared to both no anti-vortex ribs and eight anti-vortex ribs. For example, it was determined that, holding other parameters constant, four ribs provided an 11% improvement in flow rate when compared to eight ribs.

All of the ribs 80 and 90 depend transversely (vertically) from the underside of the drain cover 40, and can be parallel to the center axis 92. The structural ribs 80 are sized to meet the loading requirements of a covered shower drain, for example 300 lb-f. The shape and transverse dimension of the anti-vortex ribs 90 are selected to prevent, eliminate, disrupt or otherwise break up any vortex that would otherwise be present in the drain.

As can be seen in FIGS. 6, 7, 9 and 10, the bottom edge of the anti-vortex ribs 90 are shaped in part with a curve to follow the contour of the drain well 34 surrounding the drain opening 28. The remainder of the anti-vortex ribs 90 are configured to extend to a prescribed height "H" above the drain opening 28 when the drain cover 40 is installed in the drain well 34. Thus, the bottom edge can be straight, that is generally parallel to the top surface 42 of the drain cover 40, however, the portion show straight could also be oblique to the top surface 42, curved generally, or otherwise configured to follow a particular contour.

The prescribed height H, that is the distance from the bottom of the anti-vortex ribs 90 and a top plane of the drain opening 28, significantly effects the break up of the vortex, and in turn the flow rate through the drain. The prescribed height "H" (see FIG. 10) is selected to meet the flow conditions of particular shower applications. It has been determined empirically that for common shower applications a preferred range of heights H is 0.1 to 0.25 inches, with 0.13 inches being one preferred height which was determined in a four anti-vortex rib arrangement to provide a 3% increase in flow rate when compared to 0.25 inches, all other parameters being the same.

Figure 9:
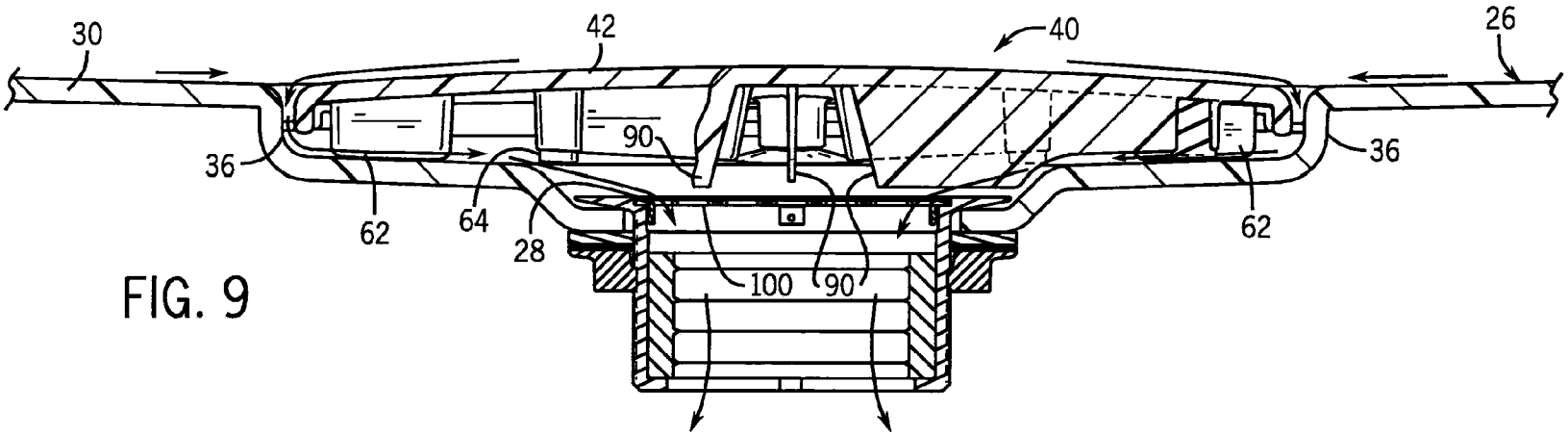
FIG. 9 is a sectional view of the covered drain taken along line 9-9 of FIG. 3.
Figure 10:
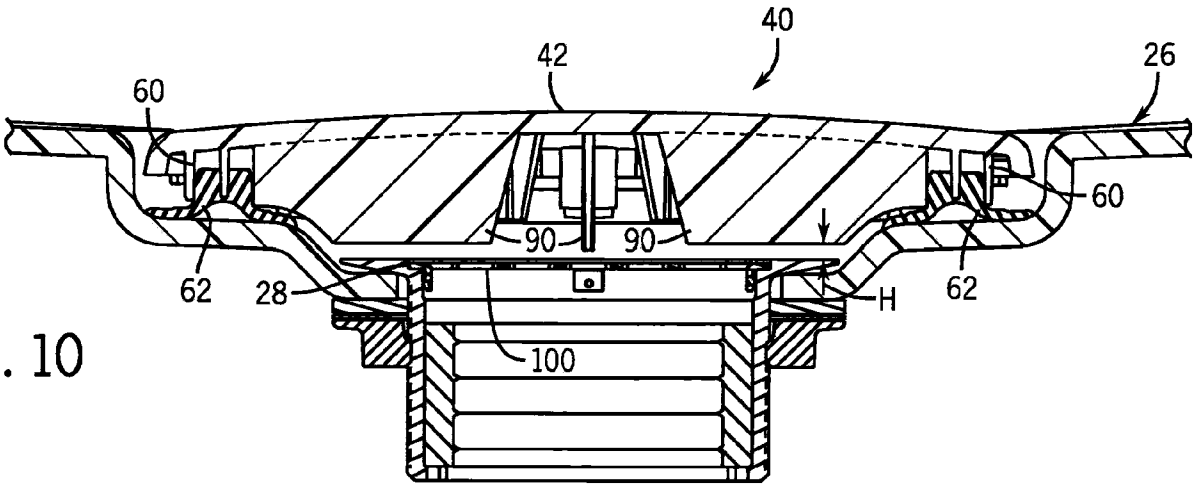
FIG. 10 is a sectional view thereof taken along line 10-10 of FIG. 3.

It was found that the presence of the drain cover 40 using anti-vortex ribs 90 to eliminate the vortex at the drain opening 28 actually increases the flow rate through the drain opening 28 over that when no drain cover 40 was used at all. Empirical study has shown that in a particular gravity fed shower drain application in which a conventional drain grate 100, as shown in FIGS. 9 and 10, was placed over the drain opening 28, has a maximum flow rate of 14 gpm through the drain opening 28 increased to 17 gpm using a drain cover 40 according to the present invention in which there was a 0.13 inch gap width at the peripheral passage 78 and a 0.13 height between the anti-vortex ribs 90 and the top of the drain opening 28.

While there has been shown and described what is at present considered a preferred embodiment of the invention, various changes and modifications can be made therein without departing from the scope of the invention defined by the appended claims. Therefore, various alternatives and revised embodiments are contemplated as being within the scope of the following claims.

INDUSTRIAL APPLICABILITY

The invention provides a base for a shower enclosure having a flat stepping area at a covered drain with peripheral flow and anti-vortex features that enhance the flow rate of water through the drain.

What is claimed is:

1. A base and drain assembly for a shower enclosure, comprising:

a receptor base for mounting at least one upright wall of the shower enclosure, the receptor base having a floor, a drain well and a drain opening, the drain well being recessed into the floor at the drain opening and defining a drain well perimeter extending about the drain opening; and a drain cover mounted within the drain well above the drain opening in essentially flush relation with areas of the floor adjacent the drain well perimeter, the drain cover having a drain cover perimeter spaced from the drain well perimeter so as to define a peripheral passage therebetween for peripheral flow to the drain opening beneath the drain cover, the drain cover having at least one anti-vortex rib extending along an underside of the drain cover and toward the drain opening proximate the drain opening so as to disrupt a vortex in the water passing through the drain opening;

wherein the at least one anti-vortex rib extends to a prescribed height above the drain opening.

2. The assembly of claim 1, wherein the drain cover has an essentially planar upper surface.

3. The assembly of claim 2, wherein the drain cover perimeter is defined by at least four sides.

4. The assembly of claim 3, wherein at least one of the sides is straight.

5. The assembly of claim 4, wherein at least one of the sides is curved.

6. The assembly of claim 1, wherein the passage has an essentially constant gap width.

7. The assembly of claim 1, wherein there are multiple anti-vortex ribs at the underside of the drain cover.

8. The assembly of claim 7, wherein the anti-vortex ribs are arranged in a radially converging configuration in which the anti-vortex ribs are spaced apart angularly and extend in radial directions so that a centerline of each anti-vortex rib intersects a vertical axis of the drain cover that passes through the drain opening when the drain cover is mounted in the drain well.

9. The assembly of claim 8, wherein the anti-vortex ribs are contoured to follow a contour of at least one of the drain well and the drain opening.

10. The assembly of claim 7, wherein there are four anti-vortex ribs equal-angularly spaced about a vertical axis of the drain cover that passes through the drain opening when the drain cover is mounted in the drain well.

11. The assembly of claim 1, wherein the drain cover includes at least one stand-off for contacting the drain well and achieving a vertical gap between the drain well and other portions of the drain cover.

12. The assembly of claim 11, wherein there are stand-offs at each corner of the drain cover.

13. The assembly of claim 11, wherein the stand-offs contact an perimetral edge surface of the drain well so as to center the drain cover within the drain well and maintain an essentially constant gap width dimension of the peripheral passage.

14. The assembly of claim 1, wherein the drain cover is adapted for removable attachment to the base receptor.

15. The assembly of claim 14, wherein the drain cover includes at least one suction cup.

16. The assembly of claim 11, wherein the prescribed height is less than 0.25 inches.

17. The assembly of claim 16, wherein the prescribed height is between 0.10 and 0.15 inches.

18. A base and drain assembly for a shower enclosure, comprising:

a receptor base for mounting at least one upright wall of the shower enclosure, the receptor base having a floor, a drain well and a drain opening, the drain well being recessed into the floor at the drain opening and defining a drain well perimeter extending about the drain opening; and a drain cover mounted within the drain well above the drain opening in essentially flush relation with areas of the floor adjacent the drain well perimeter, the drain cover having a drain cover perimeter spaced from the drain well perimeter so as to define a peripheral passage therebetween for peripheral flow to the drain opening beneath the drain cover, the drain cover having a plurality of anti-vortex ribs extending along an underside of the drain cover and toward the drain opening proximate the drain opening so as to disrupt a vortex in the water passing through the drain opening;

wherein the anti-vortex ribs are arranged in a radially converging configuration in which the anti-vortex ribs are spaced apart angularly and extend in radial directions so that a centerline of each anti-vortex rib intersects a vertical axis of the drain cover that passes through the drain opening when the drain cover is mounted in the drain well; and wherein the at least one anti-vortex rib extends to a prescribed height above the drain opening.

* * * * *

UNITED STATES PATENT AND TRADEMARK OFFICE

CERTIFICATE OF CORRECTION

PATENT NO. : 7,739,757 B2
APPLICATION NO. : 11/613272
DATED : June 22, 2010
INVENTOR(S) : Kevin L. Witt It is certified that error appears in the above-identified patent and that said Letters Patent is hereby corrected as shown below:

Column 7, in claim 16, at line 31, change [claim 11] to --claim 1--.

Signed and Sealed this

Thirty-first Day of August, 2010

David J. Kappos

David J. Kappos
*Director of the United States Patent and Trademark Office*